US008256390B1

(12) United States Patent
Bonner

(10) Patent No.: US 8,256,390 B1
(45) Date of Patent: Sep. 4, 2012

(54) SIX-CYCLE INTERNAL COMBUSTION ENGINE

(76) Inventor: M. Jeffrey Bonner, Naples, FL (US)

( * ) Notice: Subject to any disclaimer, the term of this patent is extended or adjusted under 35 U.S.C. 154(b) by 406 days.

(21) Appl. No.: 12/691,828

(22) Filed: Jan. 22, 2010

Related U.S. Application Data

(63) Continuation-in-part of application No. 12/077,962, filed on Mar. 24, 2008, now Pat. No. 7,673,596.

(51) Int. Cl.
*F02B 75/02* (2006.01)
*F02B 43/08* (2006.01)

(52) U.S. Cl. ..... 123/64

(58) Field of Classification Search ..... 123/64
See application file for complete search history.

(56) References Cited

U.S. PATENT DOCUMENTS 6,688,293 B2 2/2004 Urushihara et al.
7,472,696 B2 1/2009 Easley et al.

*Primary Examiner* — Noah Kamen
(74) *Attorney, Agent, or Firm* — Gold & Rizvi, P.A.; H. John Rizvi; Glenn E. Gold

(57) ABSTRACT

Described is a six-cycle internal combustion engine. Four of the cycles are the standard "Otto" cycles, namely intake, compression, power and exhaust plus two additional cycles, a primary intake cycle and a transfer cycle. The two additional cycles act as a supercharger to provide compressed air to the intake port of the "Otto" cycle. The engine utilizes four independently operated valves, including a transfer valve and a secondary intake valve. The transfer valve and secondary intake valve are in fluid communication via a conduit. A discharge conduit can be provided from a pressurized transfer system to release any excessive pressure within the conduit. Alternately, external pressure can be forced into the transfer conduit and a secondary intake conduit to increase the pressure within a combustion chamber.

20 Claims, 6 Drawing Sheets

SIX-CYCLE INTERNAL COMBUSTION ENGINE

CROSS-REFERENCE TO RELATED APPLICATION

This Continuation-In-Part Utility application claims the benefit of co-pending U.S. Non-Provisional patent application Ser. No. 12/077,962, filed on Mar. 24, 2008, which is incorporated herein in its entirety.

FIELD OF THE INVENTION

The present disclosure generally relates to an apparatus and method for a combustion engine. More particularly, the present disclosure relates to a six cycle combustion engine providing compressed air into a reservoir during a first compression stroke, then discharging the compressed air into the cylinder chamber during a second downward stroke providing an initial compressed pre-charge.

BACKGROUND OF THE INVENTION

The purpose of the invention and the six-cycle engine is to provide a more fuel efficient engine. The design of the engine is very similar to the standard "Otto" cycle which, of course, is well known. The "Six Stroke" was coined by the inventor of the Beare Head. The technology combines a four stroke engine bottom with an opposed piston in the head working at half the cycle of the bottom piston. The head piston works in a ported cylinder closely resembling that of a two stroke, 4+2=six stroke. A six stroke engine describes a number of different approaches in the internal combustion engine to capture the waste heat from the four stroke Otto cycle and use it to power an additional power and exhaust stroke of the piston.

U.S. Pat. No. 1,068,173 to Schimanek discloses a combustion engine in which there is combined with the usual combustion chamber, a storage receptacle for increasing the power of the working stroke of the piston.

U.S. Pat. No. 3,964,263 to Tibbs discloses a reciprocating piston engine of the type including a piston reciprocal in a cylinder toward and away from an expansion chamber at one end of a the cylinder and is also provided with intake and exhaust valves openable and closable in timed sequence with the reciprocation of the piston. During a fourth stroke of the piston, a readily vaporizable liquid is injected into the expansion chamber under pressure for flashing into vapor upon being heated by the residual heat of combustion in the expansion chamber and during the fifth and sixth stroke of the piston.

U.S. Pat. No. 4,289,097 to Ward illustrates a six cycle engine. The six cycles are a first intake stroke, a second intake stroke, a compression and combining stroke, the power stroke and the exhaust stroke. This engine provides for some of the fuel's energy that is ordinarily lost in the engine's cooling system, by absorbing heat after the first stroke and subsequently using it in the power stroke.

U.S. Pat. No. 4,917,054 illustrates a six stroke internal combustion engine wherein the six strokes are the admission of air, a first compression accompanied or followed by a possible cooling, a second compression followed by a combustion, a first expansion producing a usable work, the second expansion also producing a usable work and finally the discharge of the combustion gases.

U.S. Pat. No. 4,924,823 to Ogura et al demonstrates an internal combustion engine which generally utilises a conventional four stroke process including an intake stroke, compression stroke, expansion stroke and an exhaust stroke. In addition to the four strokes a secondary process is being used having two additional strokes for scavenging the combustion with fresh air. This two stroke scavenging process employs a fresh air intake stroke and a fresh air exhaust stroke to exhaust any remaining burnt or unburnt gases from the combustion chamber.

U.S. Pat. No. 6,311,651 to Singh discloses an internal combustion engine which is designed to operate on a six stroke cycle in which there is one cycle for injecting water into the cylinder during a predetermined portion of the cycle. Included is a central processor which is responsive to signals received from a sensor assembly mounted on the internal combustion engine at strategic locations.

U.S. Pat. No. 6,789,513 to Ziabazmi illustrates a six stroke internal combustion engine with intake-exhaust valves. All valves in the combustion chamber are named intake-exhaust valves because the valves function as both intake valves in an intake stroke and an exhaust stroke. In this engine, each cycle comprises an intake stroke, an exhaust stroke, a power stroke, an exhaust stroke, the fifth and the sixth stroke. There is an interval between the exhaust stroke and the intake stroke of the next cycle. The interval includes strokes five and six. During the exhaust stroke and the interval, all gases are expelled from the cylinder and the cylinder head completely before the intake stroke of the next cycle begins.

U.S. Pat. No. 7,143,725 Lung Tan Hu illustrates a dual six-stroke self cooling engine which utilizes a turbo and a cooling cylinder to compress cool air into the engine head and reduce the engine temperature.

SUMMARY OF THE INVENTION

The basic inventive concept for the new six cycle engine is that the engine has a power stroke every third revolution. The extra two cycles are used to draw air into the cylinder on the down stroke and then force the air into a common plenum which feeds air and fuel into the engine. The two extra cycles act as the engine supercharger. This engine completes all cycles in three revolutions of the crankshaft, which includes one fuel induction event per 3 revolutions, as compared to one fuel induction per two revolutions with the "Otto" cycle. Therefore, fuel is conserved. An additional benefit of this design is that the intake plenum or conduit pressure is adjustable via an air intake conduit valve setting and an opening rate to provide positive pressure at any engine RPM. The increased intake plenum or conduit pressure yields significantly greater low RPM engine torque and allows the designer to configure the drive train for more efficient operation at this lower RPM. Other advantages will be apparent as the description continues.

A first aspect of the present invention provides an internal combustion engine comprising:

a piston slideably assembled within a combustion chamber;

at least one camshaft to operate a minimum of four independently moving valves per one cylinder of said engine, said valves comprise one primary intake valve, one transfer valve, one secondary intake valve and one exhaust valve wherein each valve governs airflow between the combustion chamber and a respective conduit;

a primary intake conduit that feeds atmospheric air to said primary intake valve;

a transfer conduit providing fluid communication between the transfer valve and the secondary intake valve;

an exhaust conduit providing fluid communication to discharge spent gasses from said combustion chamber via the exhaust valve;

a plurality of lobes provided on the at least one camshaft, wherein the lobes operate each of the valves according to:

the primary intake valve is opened during a first downward stroke of a piston and closed prior to a subsequent first upward piston stroke;

the transfer valve is opened during the first upwards piston stroke and closed prior to a second downward piston stroke;

the secondary intake valve is opened during a second downward piston stroke and closed prior to a second upward piston stroke;

all valves are closed during a second upward piston stroke and a third downward piston stroke; and the exhaust valve is opened during a third upward piston stroke, completing the six cycles.

A second aspect of the present invention is an inclusion of a conduit air valve governing airflow through the primary intake conduit.

In yet another aspect, is an inclusion of a transfer air valve governing airflow between the transfer conduit and the secondary intake conduit.

While in another aspect, the conduit air valve and the transfer air valve are operably controlled by a linkage therebetween.

And in another aspect, the conduit air valve and the transfer air valve are each independently operably controlled by a servo motor. The servo motor could be operably controlled by a computer controller and optional sensor arrangement.

In another aspect, an excess transfer discharge conduit is integrated with the transfer conduit, providing a flow path to discharge excess air pressure from within the transfer conduit to ambient air.

In yet another aspect, is an inclusion of a transfer discharge air valve governing airflow between the transfer conduit and the excess transfer discharge conduit.

While in another aspect, the transfer air valve and the transfer discharge air valve are operably controlled by a linkage therebetween.

A method aspect of the present invention provides method of combustion for an internal combustion engine, the method comprising the steps of:

opening a primary intake valve during a first downward stroke of a piston, wherein the piston is slideably assembled within a combustion chamber, obtaining ambient air via an intake conduit, wherein the primary intake valve governs airflow between the intake conduit and the combustion chamber;

closing the primary intake valve and opening a transfer valve during a first upward stroke of the piston, passing air from within the combustion chamber into a transfer conduit, wherein the transfer valve governs airflow between the combustion chamber and the transfer conduit;

changing air pressure within the transfer conduit via an excess transfer discharge conduit, wherein the excess transfer discharge conduit provides fluid communication between the transfer conduit and one of ambient air and an air pressure source;

closing the transfer valve and opening a secondary intake valve during a second downward stroke of the piston, passing air from the transfer conduit to a secondary intake conduit and into the combustion chamber, wherein the secondary intake valve governs airflow between the secondary intake conduit and the combustion chamber;

closing the secondary intake valve, whereby all valves remain closed during a second upward, compression stroke of the piston;

providing an ignition within the combustion chamber causing combustion;

providing a power stroke during a third downward, power stroke of the piston as a result of the combustion; and opening an exhaust valve during a third upward, exhaust stroke of the piston passing spent gasses from within the combustion chamber into an exhaust conduit, wherein the exhaust valve governs airflow between the combustion chamber and the exhaust conduit.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
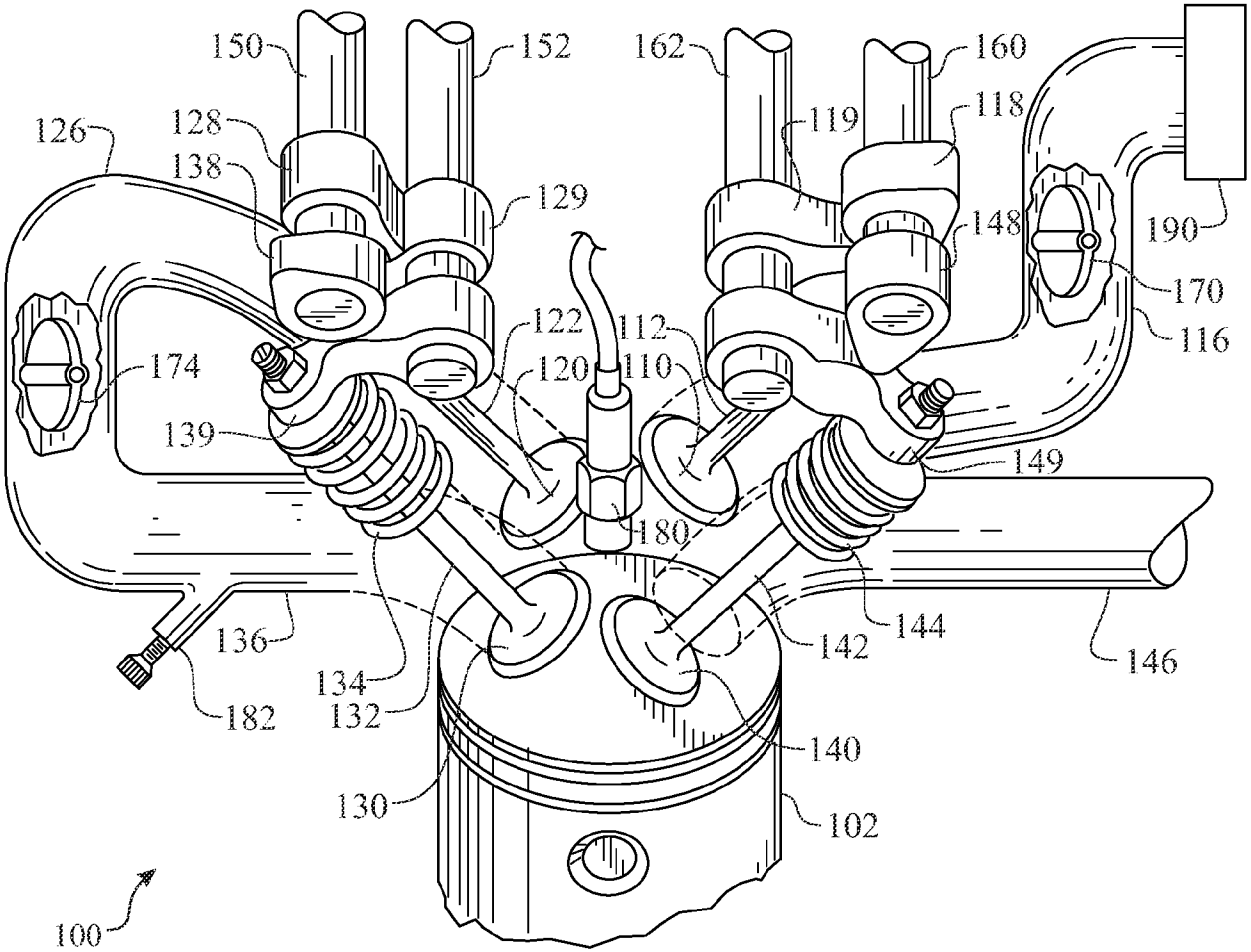
FIG. 1 presents a perspective view of the basic elements of the six-cycle engine.
Figure 2:
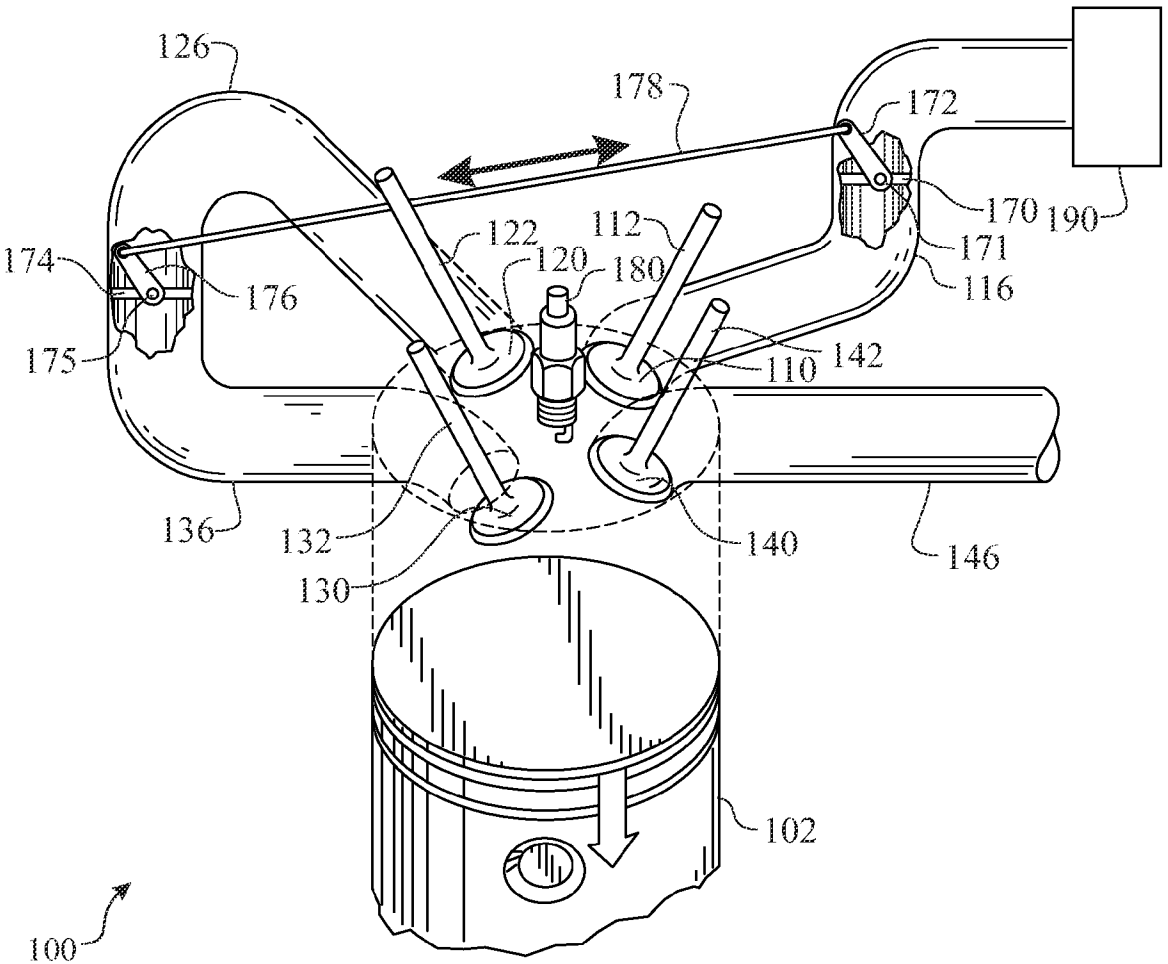
FIG. 2 presents a perspective view of the engine of FIG. 1 in an operational Mode.
Figure 3:
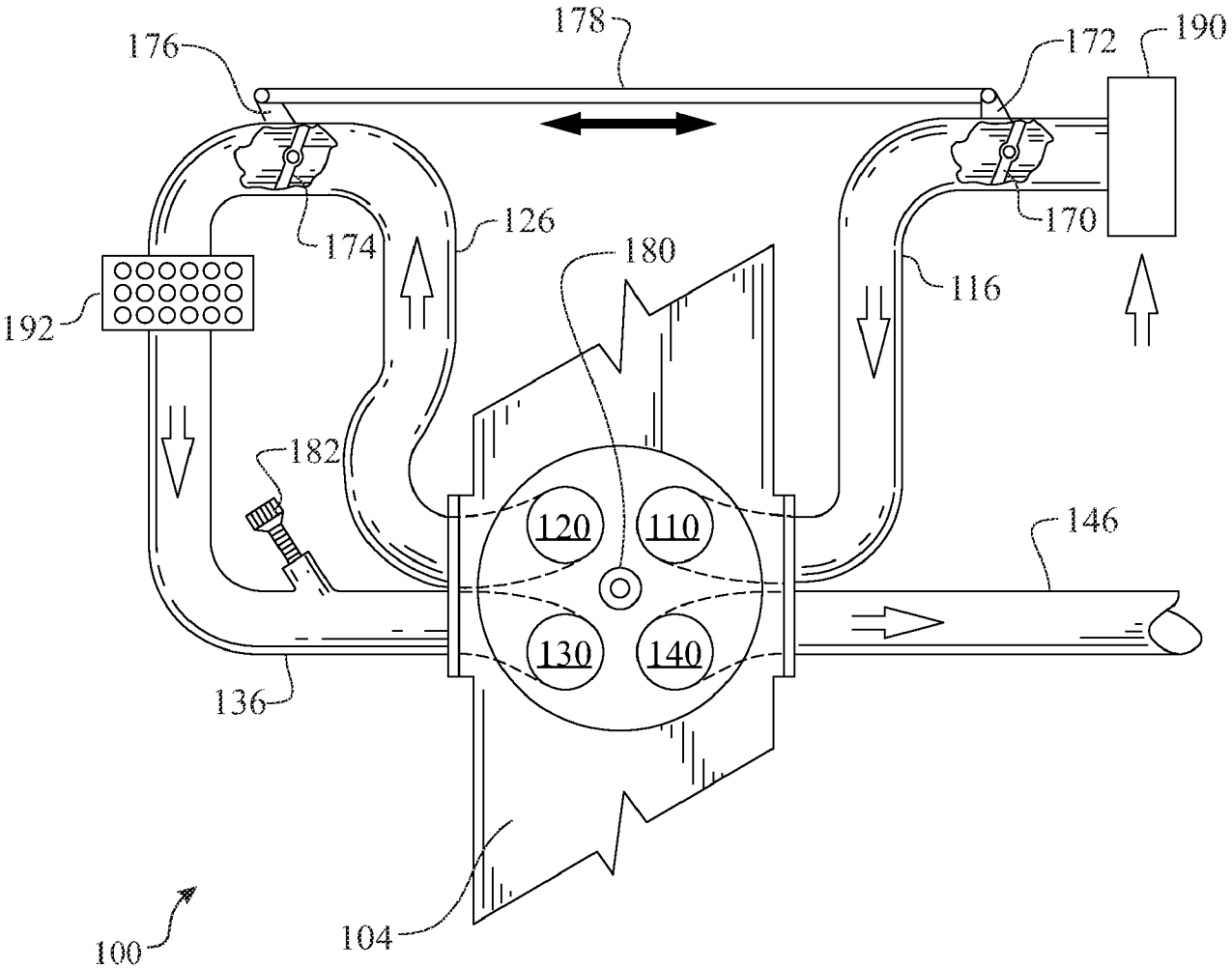
FIG. 3 presents a bottom view of the engine of FIG. 1.

An exemplary six-cycle engine cylinder configuration 100 is presented in FIGS. 1 through 3. The six-cycle engine cylinder configuration 100 includes common elements of a combustion engine, including a piston 102 slideably positioned within a cylinder head 104. A series of valves 110, 120, 130, 140 are integrated into the six-cycle engine cylinder configuration 100. A primary intake valve 110 is provided controlling entry of ambient air through a primary intake conduit air valve 170 as well as sealing a cylinder chamber provided within cylinder head 104. A transfer valve 120 is provided for sealing the cylinder chamber during the compression and combustion cycles while providing for discharge of compressed air from the cylinder chamber into a transfer conduit 126 as desired. A secondary intake valve 130 is provided for sealing the cylinder chamber during the compression and combustion cycles while providing for passage of compressed air from the cylinder chamber into a secondary intake conduit 136 as desired. An exhaust valve 140 is provided for sealing the cylinder chamber during the compression and combustion cycles while providing for passage of compressed air from the cylinder chamber into an exhaust conduit 146 as desired during an exhaust discharge cycle. Each valve includes a respective valve stem 112, 122, 132, 142. Each valve is operated by a mechanical drive mechanism. A series of cam lobes 118, 128, 138, 148 are disposed upon camshafts 150, 160. The cam lobes 118, 128, 138, 148 are in operable communication with a respective rocker arm 119, 129, 139, 149. Two valve springs, which are not shown but understood to be associated with the primary and transfer intake valves 112, 122, and valve springs 134, 144 ensure the rocker arms 119, 129, 139, 149 remain engaged with the cam lobes 118, 128, 138, 148.

The following table defines the relation between each of the components:

TABLE 1

Valve component Element Reference

| Function | Valve | Valve Stem | Valve Spring | Cam lobe | Rocker Arm |
|---|---|---|---|---|---|
| Primary Intake | 110 | 112 | not shown | 118 | 119 |
| Transfer Intake | 120 | 122 | not shown | 128 | 129 |
| Secondary Intake | 130 | 132 | 134 | 138 | 139 |
| Exhaust | 140 | 142 | 144 | 148 | 149 |

The transfer camshaft 150 is formed having a series of lobes, such as the transfer cam lobe 128 and secondary intake cam lobe 138. A transfer rocker arm shaft 152 is provided for assembling a series of rocker arms to the six-cycle engine cylinder configuration 100, such as the transfer valve rocker arm 129 and secondary intake valve rocker arm 139. The lobes 128, 138 are formed upon the transfer camshaft 150 in an offset relation to properly control the valve operational sequence. Similarly, the common camshaft 160 is formed having a series of lobes, such as the primary cam lobe 118 and exhaust cam lobe 148. A common rocker arm shaft 162 is provided for assembling a series of rocker arms to the six-cycle engine cylinder configuration 100, such as the primary valve rocker arm 119 and exhaust valve rocker arm 149. The lobes 118, 148 are formed upon the common camshaft 160 in an offset relation to properly control the valve operational sequence.

Ambient air enters the cylinder chamber through the intake conduit 116. The air is filtered prior to entry into the intake conduit 116 by passing through an air filter 190. Initial airflow can be controlled by an air intake system, such as a carburetor, a throttle body, and the like. A primary intake conduit air valve 170 is assembled within the intake conduit 116 providing a means for controlling the system airflow rates. The primary intake conduit air valve 170 works in harmony with a transfer conduit air valve 174 provided within a transition between the transfer conduit 126 and the secondary intake conduit 136.

Each air valve 170, 174 is rotationally assembled within the respective conduit via an air valve shaft 171, 175 respectively. The primary intake conduit air valve 170 and transfer conduit air valve 174 can be controlled via any reasonable means. An air valve control lever 172, 176 can be assembled to the air valve shaft 171, 175 respectively, providing operational control to the respective air valve 170, 174. Each air valve 170, 174 can be independently controlled via a controller motor attached either directly to the air valve shaft 171, 175 or to the air valve control lever 172, 176. A computer control system can be integrated into the system, providing optimal independent control for each of the air valves 170, 174. Alternately, the air valves 170, 174 can be mechanically controlled via a series of mechanical linkages. An air valve linkage 178 can be provided between the primary intake conduit air valve lever 172 and transfer conduit air valve lever 176 to operate each of the air valves 170, 174 in unison. The air valve linkage 178 is arranged wherein when primary intake conduit air valve 170 is closed, transfer conduit air valve 174 will also be closed. The linkage 178 can be mechanically operated by a gas pedal of a vehicle.

A spark plug 180, or other ignition device, is provided for initiating the combustion sequence. A fuel jet 182 can be integrated within the secondary intake conduit 136 proximate the secondary intake valve 130. A heat exchanger 192 can be provided along the transfer conduit 126 or secondary intake conduit 136 to remove heat from the air as it flows from the transfer valve 120 to the secondary intake valve 130. The cooling condenses the air allowing denser air to enter the cylinder chamber.

The six-cycle engine cylinder configuration 100 operates in accordance with six (6) cycles.

The cycle begins with the piston 102 being positioned at top dead top center (TDC), following an exhaust cycle.

The primary intake valve 110 opens as the piston 102 initiates in its first downward stroke. The suction created by the downward motion of piston 102 causes ambient air to be drawn through air filter 190, past the primary intake conduit air valve 170 and through the intake conduit 116 to thereby fill the space in the cylinder chamber above the piston 102. The amount of air that moves into the vacant space above the piston 102 is a function of the duration of time in which the primary intake valve 110 is open, the height in which the valve moves (which governs the allowable airflow), the diameter of the primary intake valve 110, and the bore diameter of the intake conduit 116 and the rotational position of the primary intake conduit air valve 170. The first cycle is completed when the primary intake valve 110 is closed, preferably when the piston 102 is positioned at approximately Bottom Dead Center (BDC).

The second cycle initiates by opening the transfer valve 120 as the piston 102 begins a first compression motion from BDC. The transfer valve 120 continues to open as the piston 102 moves toward the TDC position. The upward movement of the piston 102 drives the trapped air in the cylinder chamber above the piston 102 to be forced through the transfer valve 120, into the transfer conduit 126, continuing into the secondary intake conduit 136. The valve opening characteristics of the transfer valve 120 are designed such that the maximum volume of air above the piston 102 is transferred through the transfer conduit 126, continuing into the secondary intake conduit 136. The airflow from the secondary intake conduit 136 into the cylinder chamber is controlled via secondary intake valve 130. The second cycle is completed when the piston 102 is positioned at TDC.

The third cycle initiates when the piston 102 is at TDC and the secondary intake valve 130 opens. The piston 102 now moves downward and causes the air within the transfer conduit 126 to flow past the transfer conduit air valve 174 and the optional heat exchanger 192 within the transfer conduit 126. The rotational position of the transfer conduit air valve 174 determines the engine speed most likely controlled by the gas pedal. The heat exchanger 192 removes heat from the air, which was generated by the compression of the air from second cycle described above. An optional fan (not shown, but well understood by description) can blow ambient air across the heat exchanger to aid in the removal of heat from the transferred air. Fuel is introduced into the airflow passing through the secondary intake conduit 136 by a fuel jet 182 and enters the combustion chamber through the secondary intake valve 130. The volume of air that enters the combustion chamber is determined by the opening profile of the secondary intake valve 130, the rotational position of the transfer conduit air valve 174 and the amount of positive air pressure within the transfer conduit 126 and the secondary intake conduit 136 (along with other variables mentioned previously). The secondary intake valve 130 closes when the piston 102 is positioned at BDC, completing the third cycle.

The fourth cycle initiates when the piston 102 is at BDC, initiating a compression stroke for combustion, in accordance with a common "Otto" cycle. All four valves 110, 120, 130, 140 are closed. The piston 102 moves upward compressing the air fuel mixture above the piston, completing the fourth cycle.

Ignition occurs in a transition between the fourth and fifth cycles, when the piston 102 is at approximately TDC.

Subsequent ignition, the piston 102 moves downward providing a power stroke. This cycle is in accordance with the standard "OTTO" cycle, completing the fifth cycle.

The sixth cycle initiates as the piston 102 transitions from BDC towards TDC. The exhaust valve 140 opens at approximately the piston's BDC and the spent gasses are expelled into the atmosphere through the exhaust valve 140 and the exhaust conduit 146 as the piston moves upward into its TDC position, completing the sixth and final cycle of the six-cycle engine cylinder configuration 100.

During the process, it is desirable that the primary intake conduit air valve 170 and transfer conduit air valve 174 be synchronized. This can be accomplished in a variety of ways. One such means is to incorporate an air valve linkage 178 mechanically connecting each of the primary intake conduit air valve 170 and transfer conduit air valve 174 such that rotational motion of one creates a similar rotational motion of the other. A second such means would be to attach a servo (or similar) motor to each of the air valves 170, 174. The primary air valve 170 can be manipulated via servo motor such that rotational position of 170 relative to 174 produces the desired intake manifold pressure at any given condition. The engine output torque curve is thus modified with this system to deliver the power required at any engine RPM.

The primary intake conduit air valve 170 can be manipulated to offer maximum cylinder pressure for a given fuel type since some alternative fuels, like alcohols, resist detonation under very high engine compression ratios.

Positive air pressure within the secondary intake conduit 136 produces higher than normal airflow and fuel flow into the six-cycle engine cylinder configuration 100 during the filling stage. This higher airflow consumes somewhat increased fuel usage at a given RPM but the overall effect is that increased engine torque is available at a lower RPM. This lower operating RPM coupled with a more conservative output gearing results in an overall reduced operating fuel consumption rate.

Figure 4:
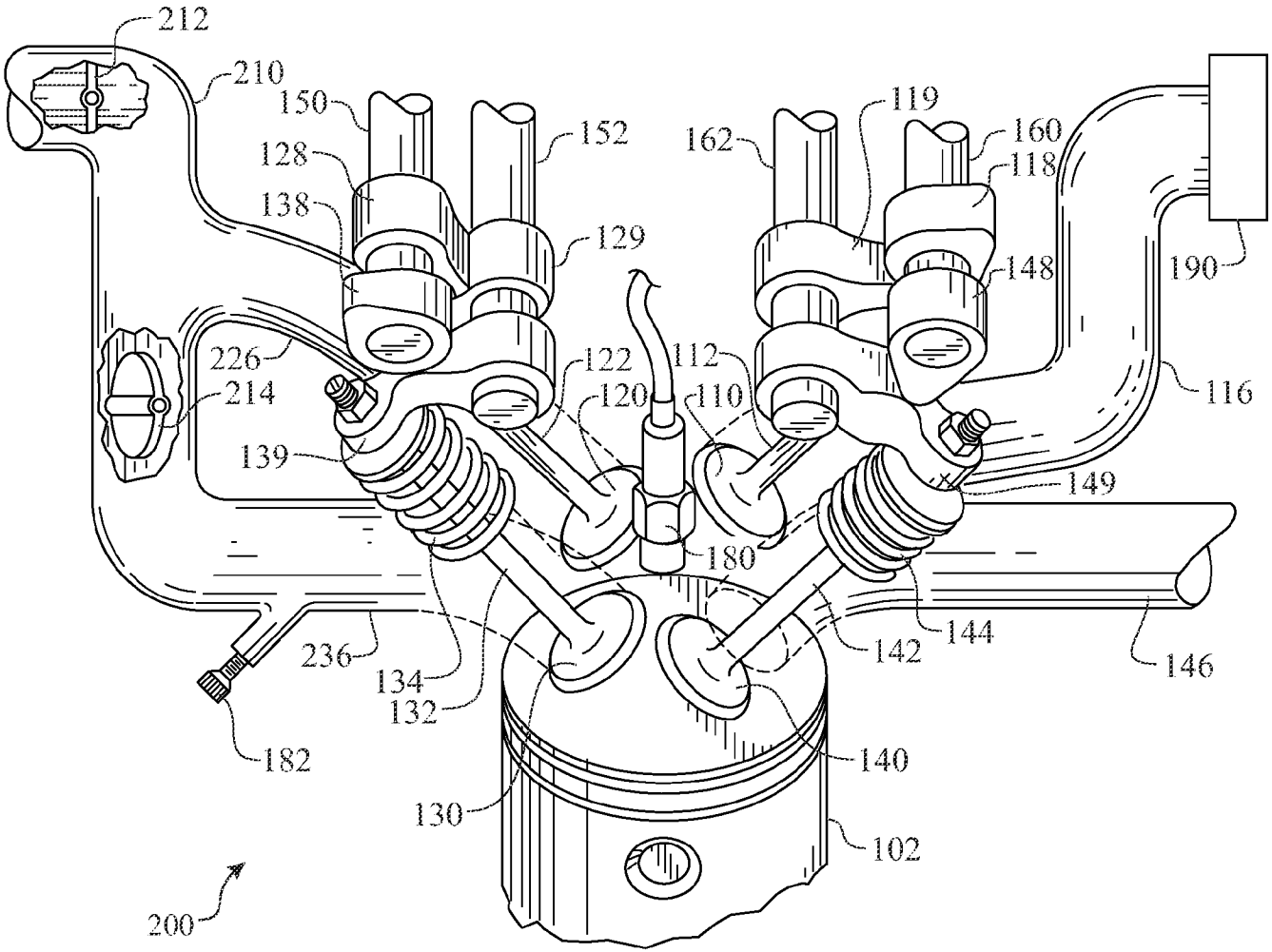
FIG. 4 presents an enhanced six-cycle engine.
Figure 5:
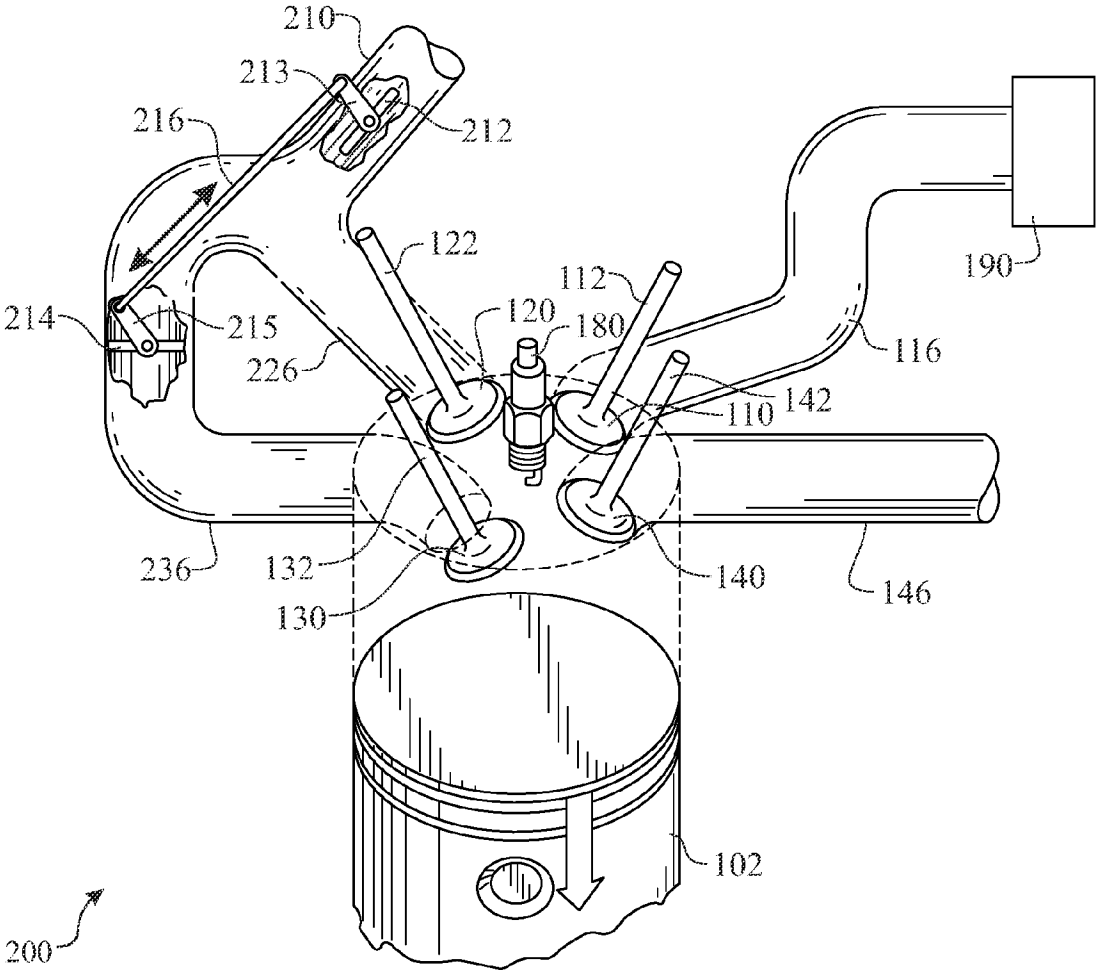
FIG. 5 presents a perspective view of the enhanced engine of FIG. 4 in an operational Mode.
Figure 6:
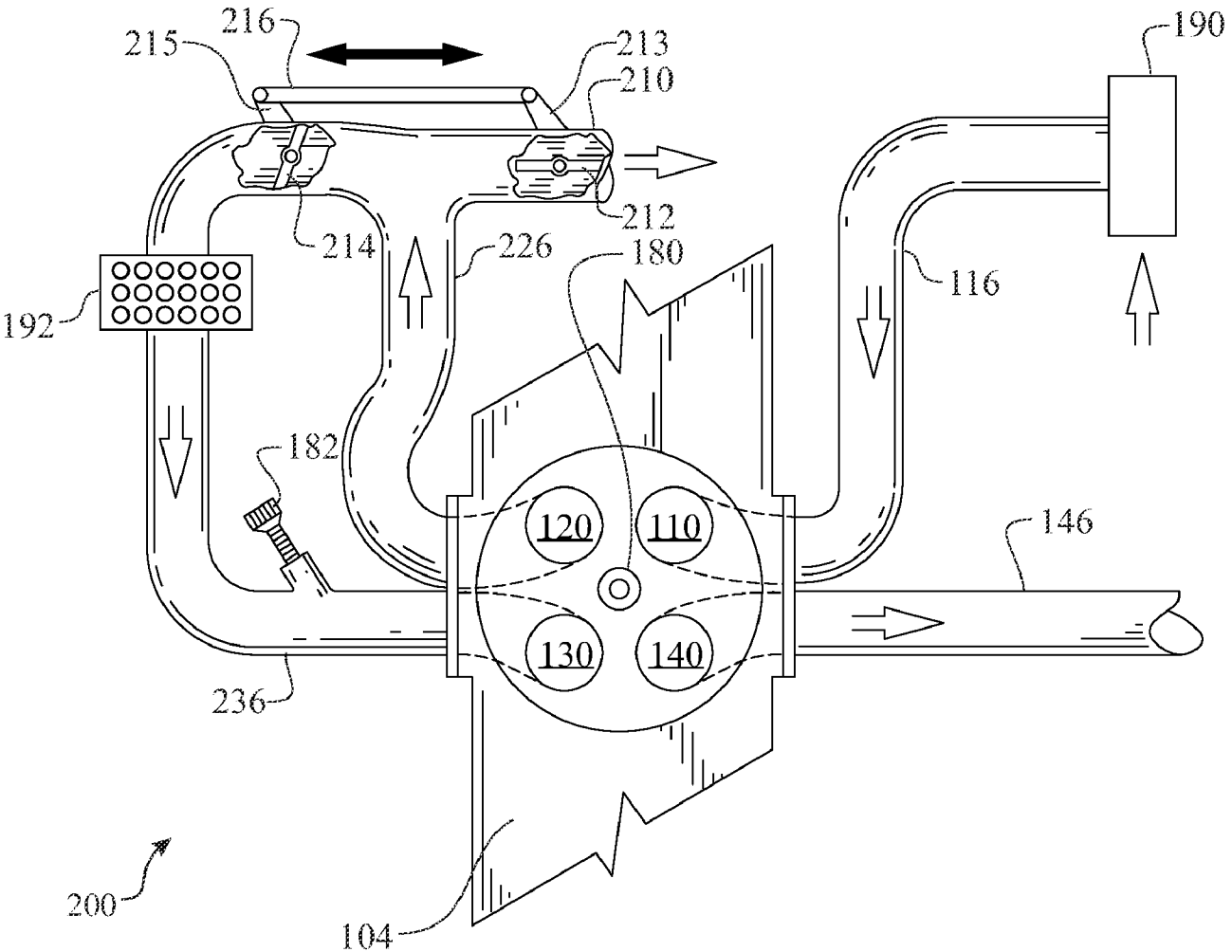
FIG. 6 presents a bottom view of the enhanced engine of FIG. 4.

An alternate embodiment, referred to as a six-cycle engine cylinder configuration 200 is presented in FIGS. 4 through 6. The six-cycle engine cylinder configuration 200 comprises a majority of the same components as the six-cycle engine cylinder configuration 100, with the modifications being directed at the transfer conduit 126 and secondary intake conduit 136. The transfer conduit 126 and the secondary intake conduit 136 are replaced by a similar transfer conduit 226 and secondary intake conduit 236. A transfer conduit air valve 214 is provided between the continuous conduit forming the transfer conduit 226 and secondary intake conduit 236. The transfer conduit air valve 214 provides the same functions as the transfer conduit air valve 174 of the six-cycle engine cylinder configuration 100. An excess transfer discharge conduit 210 is plumbed in fluid communication with the transfer conduit 226 to provide a discharge flow path for any excess pressure formed within the transfer conduit 226. An excess transfer discharge valve 212 is integrated within the excess transfer discharge conduit 210. The six-cycle engine cylinder configuration 200 incorporates a pressure relief system within a transfer conduit 226. The excess transfer discharge valve 212 would open to vent excess pressure from the transfer conduit 226 via the excess transfer discharge conduit 210, while the transfer conduit air valve 214 is in a closed orientation. The excess transfer discharge valve 212 would remain closed when the transfer conduit air valve 214 is in an open orientation. An excess transfer discharge valve lever 213 can be assembled to the excess transfer discharge valve 212 for aiding in controlling the rotational position of the excess transfer discharge valve 212. Similarly, a transfer conduit air valve linkage lever 215 can be assembled to the transfer conduit air valve 214 for aiding in controlling the rotational position of the excess transfer discharge valve 212. An air valve linkage 216 can provide mechanical engagement between the excess transfer discharge valve lever 213 and the transfer conduit air valve linkage lever 215, providing synchronized motion of the excess transfer discharge valve 212 and the transfer conduit air valve 214. A servo motor or similar can be connected to each of the excess transfer discharge valve 212 and transfer conduit air valve 214 to provide independent control of the air valves 212, 214. The independent control would be governed by a computer, various sensors, and the like to optimize timing, flow, pressure, and the like. Other elements of the six-cycle engine cylinder configuration 200, such as the fuel jet 182 and the heat exchanger 192 remain as described in FIGS. 1 through 3.

Operation of the six-cycle engine cylinder configuration 200 is similar to the operation of the six-cycle engine cylinder configuration 100 previously described. The excess transfer discharge valve 212 offers the additional ability to regulate the collected pressurized air within the transfer conduit 226, allowing any excess pressure to be discharged to the atmosphere.

Alternately, an external pressure system can be adapted to an opening of the excess transfer discharge conduit 210. The excess transfer discharge valve 212 is then utilized to regulate airflow from the external source through the excess transfer discharge conduit 210. Operation of the six-cycle engine cylinder configuration 200 is similar to the operation of the six-cycle engine cylinder configuration 100 previously described. The excess transfer discharge valve 212, in this configuration, offers the additional ability to regulate the flow of additional pressurized air applied to the excess transfer discharge conduit 210 into the transfer conduit 226. During the application of the externally sourced pressure, the transfer valve 120 remains closed, forcing the pressurized air into the secondary intake conduit 236. The externally sourced pressure is regulated via a combination of the transfer conduit air valve 214 and the secondary intake valve 130.

In the preferred embodiment, the driver via an accelerator pedal or other controlling mechanism operates the transfer conduit air valve 174. Operation of the primary intake conduit air valve 170 and/or the transfer conduit air valve 214 would be conditioned from the operation of the transfer conduit air valve 174. Essentially, the operation of the primary intake conduit air valve 170 is a function of the transfer conduit air valve 174.

Below are a few typical scenarios for this style engine fitted to an automobile.

At idle, fuel consumption is reduced because of the fact that there is only 1 fuel injection event per 3 crankshaft revolutions for the six-cycle engine cylinder configuration 100, compared to a 1:2 ratio of the common "Otto" cycle. Upon acceleration, from a stop, the accelerator pedal in the six-cycle engine cylinder configuration 100 is depressed only slightly to get the vehicle moving because of the increased torque at low RPM. Fuel is conserved because the engine does not require heavy accelerator pedal positions and increased engine RPM for the same level of acceleration.

At a steady engine speed, fuel is conserved because of the 1:3 power stroke fuel rationing as opposed to the 1 in 2 ratio associated with the "Otto" cycle engine. Fuel is injected once every third revolution of the crankshaft instead of once every second revolution of the crankshaft. Fuel is further conserved since the output gearing is more conservative in the 1 in 3 power stroke engine which operates at a lower engine RPM for a given comparable vehicle speed due to increased low RPM torque.

It is important to know that in six-cycle engine cylinder configuration 100, 200 there are a minimum of 4 valves used to control the airflow through each cylinder. However, the valves do not operate in unison but operate independently from each other. On each camshaft the rocker arms are operated by cam lobes, which are generally offset from each other by at least 90 degrees. This then, results in the fact that each valve has its own respective cam lobe that opens and closes the valve independently of the other valves but such opening and closing is in synchronization with the crankshaft of the engine by way of timing belts or chains.

The six-cycle engine cylinder configuration 100, 200 can be designed to utilize any of the many well-known combustible fuels. The intake plenum or conduit pressure can be tailored to suit the needs of the fuel that is chosen. Some fuels, such as diesel and alternate fuels such as bio-diesel and alcohol, can tolerate much higher operating pressures as compared to gasoline. These higher cylinder pressures yield increased engine efficiency without the risk of engine damage from detonation. Higher efficiency engines yield higher power output for a given amount of fuel consumed.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

I claim:

1. A method of combustion for an internal combustion engine, the method comprising the steps of opening a primary intake valve during a first downward stroke of a piston, wherein the piston is slideably assembled within a combustion chamber, obtaining ambient air via an intake conduit, wherein the primary intake valve governs airflow between the intake conduit and the combustion chamber;

closing the primary intake valve and opening a transfer valve during a first upward stroke of the piston, passing air from within the combustion chamber into a transfer conduit, wherein the transfer valve governs airflow between the combustion chamber and the transfer conduit;

closing the transfer valve and opening a secondary intake valve during a second downward stroke of the piston, passing air from the transfer conduit to a secondary intake conduit and into the combustion chamber, wherein the secondary intake valve governs airflow between the secondary intake conduit and the combustion chamber;

closing the secondary intake valve, whereby all valves remain closed during a second upward, compression stroke of the piston;

providing an ignition within the combustion chamber causing combustion;

providing a power stroke during a third down downward, power stroke of the piston as a result of the combustion; and opening an exhaust valve during a third upward, exhaust stroke of the piston passing spent gasses from within the combustion chamber into an exhaust conduit, wherein the exhaust valve governs airflow between the combustion chamber and the exhaust conduit.

2. A method of combustion as recited in claim 1, the method further comprising the step of:

controlling airflow into the primary intake conduit via a primary intake airflow valve.

3. A method of combustion as recited in claim 2, the method further comprising the step of:

controlling airflow between the transfer valve and secondary intake valve via a transfer airflow valve positioned within one of the transfer conduit and the secondary intake conduit.

4. A method of combustion as recited in claim 3, the method further comprising the step of:

controlling the primary intake airflow valve via a primary intake airflow valve rotational motor;

controlling the transfer airflow valve via a transfer airflow valve rotational motor; and controlling each of the rotational motors via a computer controller.

5. A method of combustion as recited in claim 3, the method further comprising the step of:

controlling the primary intake airflow valve and transfer airflow valve via a linkage provide between the primary intake airflow valve and transfer airflow valve.

6. A method of combustion as recited in claim 1, the method further comprising the step of:

controlling airflow between the transfer valve and secondary intake valve via an airflow valve positioned within one of the transfer conduit and the secondary intake conduit.

7. A method of combustion as recited in claim 1, the method further comprising the step of:

utilizing an excess transfer discharge airflow valve for controlling and discharging any excessive pressure accumulated within the transfer conduit via an excess transfer discharge conduit, wherein the excess transfer discharge conduit is in fluid communication with the transfer conduit.

8. A method of combustion for an internal combustion engine, the method comprising the steps of:

opening a primary intake valve during a first downward stroke of a piston, wherein the piston is slideably assembled within a combustion chamber, obtaining ambient air via an intake conduit, wherein the primary intake valve governs airflow between the intake conduit and the combustion chamber;

closing the primary intake valve and opening a transfer valve during a first upward stroke of the piston, passing air from within the combustion chamber into a transfer conduit, wherein the transfer valve governs airflow between the combustion chamber and the transfer conduit;

changing air pressure within the transfer conduit via an excess transfer discharge conduit, wherein the excess transfer discharge conduit provides fluid communication between the transfer conduit and one of ambient air and an air pressure source;

closing the transfer valve and opening a secondary intake valve during a second downward stroke of the piston, passing air from the transfer conduit to a secondary intake conduit and into the combustion chamber, wherein the secondary intake valve governs airflow between the secondary intake conduit and the combustion chamber;

closing the secondary intake valve, whereby all valves remain closed during a second upward, compression stroke of the piston;

providing an ignition within the combustion chamber causing combustion;

providing a power stroke during a third down downward, power stroke of the piston as a result of the combustion; and opening an exhaust valve during a third upward, exhaust stroke of the piston passing spent gasses from within the combustion chamber into an exhaust conduit, wherein the exhaust valve governs airflow between the combustion chamber and the exhaust conduit.

9. A method of combustion as recited in claim 8, the method further comprising the step of:

reducing air pressure within the transfer conduit via an excess transfer discharge airflow valve, wherein the excess transfer discharge airflow valve governs airflow between the transfer conduit and ambient air.

10. A method of combustion as recited in claim 8, the method further comprising the step of:

increasing air pressure within the transfer conduit by providing an increase airflow from an external airflow generating source into the excess transfer discharge conduit, the airflow is governed via an excess transfer discharge airflow valve, wherein the excess transfer discharge airflow valve governs airflow between the external airflow generating source and the transfer conduit.

11. A method of combustion as recited in claim 8, the method further comprising the step of:

controlling airflow into the primary intake conduit via a primary intake airflow valve.

12. A method of combustion as recited in claim 1 the method further comprising the step of:

controlling airflow between the transfer valve and secondary intake valve via a transfer airflow valve positioned within one of the transfer conduit and the secondary intake conduit.

13. A method of combustion as recited in claim 12, the method further comprising the step of:

controlling the primary intake airflow valve via a primary intake airflow valve rotational motor;

controlling the transfer airflow valve via a transfer airflow valve rotational motor; and controlling each of the rotational motors via a computer controller.

14. A method of combustion as recited in claim 12, the method further comprising the step of:

controlling the primary intake airflow valve and transfer airflow valve via a linkage provided between the primary intake airflow valve and transfer airflow valve.

15. A method of combustion as recited in claim 9, the method further comprising the step of:

controlling airflow between the transfer valve and secondary intake valve via an airflow valve positioned within one of the transfer conduit and the secondary intake conduit.

16. An internal combustion engine comprising:

a piston slideably assembled within a combustion chamber;

at least one camshaft to operate a minimum of four independently moving valves per one cylinder of said engine, said valves comprise one primary intake valve, one transfer valve, one secondary intake valve and one exhaust valve wherein each valve governs airflow between the combustion chamber and a respective conduit;

a primary intake conduit that feeds atmospheric air to said primary intake valve;

a transfer conduit providing fluid communication between the transfer valve and the secondary intake valve;

an exhaust conduit providing fluid communication to discharge spent gasses from said combustion chamber via the exhaust valve;

a plurality of lobes provided on the at least one camshaft, wherein the lobes operate each of the valves according to:

the primary intake valve is opened during a first downward stroke of a piston and closed prior to a subsequent first upward piston stroke;

the transfer valve is opened during the first upwards piston stroke and closed prior to a second downward piston stroke;

the secondary intake valve is opened during a second downward piston stroke and closed prior to a second upward piston stroke;

all valves are closed during a second upward piston stroke and a third downward piston stroke; and the exhaust valve is opened during a third upward piston stroke, completing the six cycles.

17. An internal combustion engine as recited in claim 16, the engine further comprising a primary intake airflow valve governing airflow through the primary intake conduit to the intake valve.

18. The internal combustion engine of claim 16, the engine further comprising a transfer airflow valve governing airflow between the transfer valve and the secondary intake valve.

19. The internal combustion engine of claim 16, the engine further comprising:

a primary intake airflow valve governing airflow through the primary intake conduit to the intake valve;

a transfer airflow valve governing airflow between the transfer valve and the secondary intake valve, and a controller for operation of each of the transfer airflow valve and the primary intake airflow valve.

20. The internal combustion engine of claim 16, the engine further comprising a heat exchanger in thermal communication with the transfer second conduit.

* * * * *